United States Patent [19]

Jones

[11] 4,065,653

[45] Dec. 27, 1977

[54] CIRCUIT BREAKER MOUNTED WITHIN AN EXPLOSION-PROOF ENCLOSURE

[75] Inventor: William B. Jones, Bloomington, Ill.

[73] Assignee: General Electric Company, New York, N.Y.

[21] Appl. No.: 790,775

[22] Filed: Apr. 25, 1977

[51] Int. Cl.[2] ..... H01H 9/04

[52] U.S. Cl. ..... 200/302; 200/306

[58] Field of Search ..... 200/306, 302, 144 R; 174/50

[56] References Cited

U.S. PATENT DOCUMENTS

| | | | |
|---|---|---|---|
| 2,925,484 | 2/1960 | Thommen | 200/148 R |
| 3,155,803 | 11/1964 | Klein et al. | 200/153 G |
| 3,171,927 | 3/1965 | Klein et al. | 337/70 |
| 3,264,435 | 8/1966 | Klein et al. | 337/48 |

FOREIGN PATENT DOCUMENTS

| | | | |
|---|---|---|---|
| 15,333 | 4/1953 | Germany | 200/144 R |

*Primary Examiner*—Arthur T. Grimley
*Assistant Examiner*—John H. Bouchard
*Attorney, Agent, or Firm*—Stephen A. Young; Walter C. Bernkopf; Robert A. Cahill

[57] ABSTRACT

An improved circuit breaker is mounted within an explosion-proof enclosure. The circuit breaker has an insulated case and a manually operable handle extending from one surface of the case. Also provided are means which are operable externally of the enclosure for moving the handle of the circuit breaker between an on and an off position. The circuit breaker further includes means located on opposite sides of the handle for preventing exploding gases within the explosion-proof enclosure from shattering the case of the circuit breaker.

10 Claims, 8 Drawing Figures

CIRCUIT BREAKER MOUNTED WITHIN AN EXPLOSION-PROOF ENCLOSURE

BACKGROUND OF THE INVENTION

1. Field of the Invention

This invention relates to an improved circuit breaker, and, more particularly, to an improvement in the case of the circuit breaker which is located within an explosion-proof enclosure.

2. Description of the Prior Art

An explosion-proof threaded enclosure for housing circuit breakers and motor starters of the type described in U.S. Pat. No. 4,005,615, and assigned to the same assignee as the present invention, has been used in hazardous environments such as oil fields. The use of circuit breakers within threaded explosion-proof enclosures in such hazardous environments can result in the enclosure having explosive gases contained therewithin. It is not unlikely that these explosive gases, which can exist both internally and externally of a circuit breaker housing, can ignite, thereby causing the generation of forces great enough to actually shatter the case of the circuit breaker. Upon continuous shattering of various parts of the circuit breaker case, there is the possibility that shattered parts of the case will be thrusted into positions either within or without the circuit breaker that could cause either the circuit breaker or other components within the explosion-proof enclosure to become inoperative.

OBJECTS OF THE INVENTION

It is an object of this invention to improve the design of the case of a circuit breaker placed within an explosion-proof enclosure to prevent the shattering of the circuit breaker case by exploding gases within the explosion-proof enclosure.

This and other objects of the invention will be pointed out hereinafter.

SUMMARY OF THE INVENTION

According to a broad aspect of the invention, there is provided an improved circuit breaker case mounted within an explosion-proof enclosure. The circuit breaker includes a manually operable handle member extending from one surface of the case and movable between an on and an off position for opening and closing the circuit breaker. Means operable externally of the enclosure for moving the handle of the circuit breaker between the on and off positions is also provided. Further provided is means, provided by the case of the circuit breaker and located on opposite sides of the handle of the circuit breaker, for preventing exploding gases within the explosion-proof enclosure from shattering the case of the circuit breaker.

The case of the circuit breaker is comprised of a base portion, and a cover portion attached to the base portion. The cover portion has a top part and at least first and second sides extending from opposite edges of the top part and along a direction parallel to the longitudinal axis of the cover portion. The handle of the circuit breaker extends through the top part along the longitudinal axis of the cover portion, and the circuit breaker further includes therein a trip mechanism housing and arc extinguishing means centrally positioned along the longitudinal axis of the cover portion and on opposite sides of the handle.

The means for preventing exploding gases within the explosion-proof enclosure from shattering the circuit breaker is comprised of each of the sides of the cover portion having a hole located therein and extending substantially between the trip mechanism housing and the arc extinguishing means. The preventing means can further include a pair of holes extending through the top part of the cover portion located on respective opposite sides of the handle and between the trip mechanism housing and the arc extinguishing means. Structural supporting plates can also be placed over that portion of the top part of the cover portion which overlies the trip mechanism housing, and that portion of the top part of the cover which overlies the arc extinguishing means.

In another embodiment, the trip mechanism housing can have slots extending therewithin for allowing exploding gases to pass between these slots and the holes in the side of the cover portion to prevent the shattering of the trip mechanism housing and the cover portion of the circuit breaker.

DESCRIPTION OF THE PREFERRED EMBODIMENTS

Figure 1:
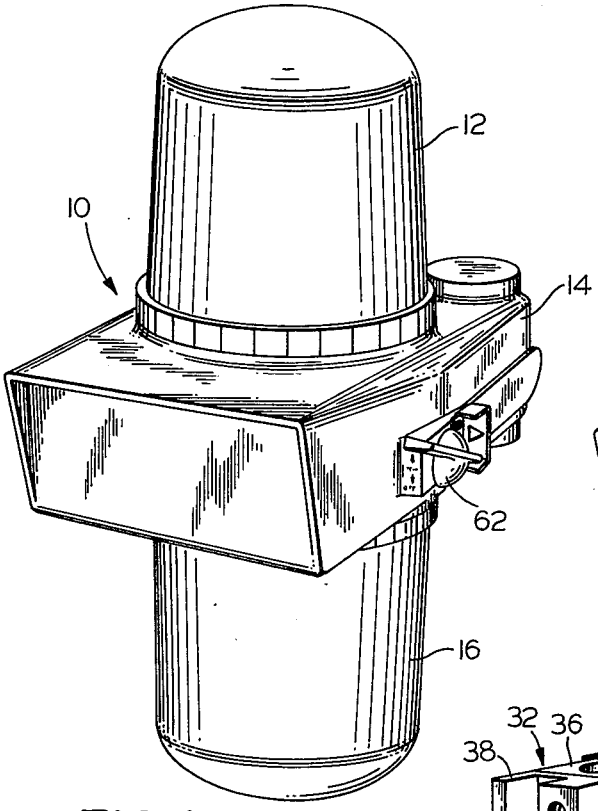
FIG. 1 is a perspective view of a threaded explosion-proof enclosure in accordance with the invention.

Referring now to FIGS. 1–6, one embodiment of the invention will now be explained. As shown in FIG. 1, there is provided a threaded explosion-proof enclosure 10 of the type generally described in U.S. Pat. No. 4,005,615 assigned to the same assignee as the assignee of the present invention, and in U.S. Pat. No. 3,016,431. This enclosure includes a top part 12, a medial part 14 and a bottom part 16, wherein the top and medial parts are screwed together via mating threaded sections, and the bottom and medial parts are likewise screwed together via mating threaded sections.

Figure 2:
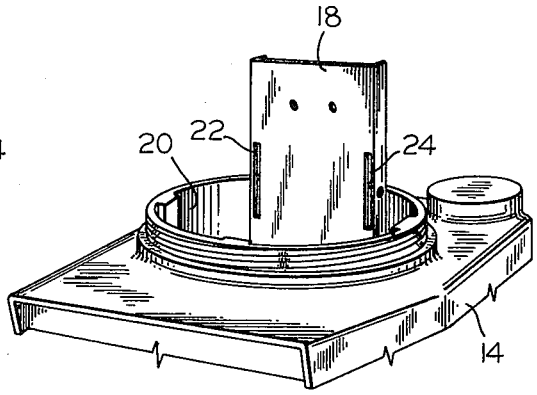
FIG. 2 is an enlarged perspective view of a cutaway portion of a medial part of the explosion-proof enclosure and a mounting plate extending outward from the medial part.
Figure 3:
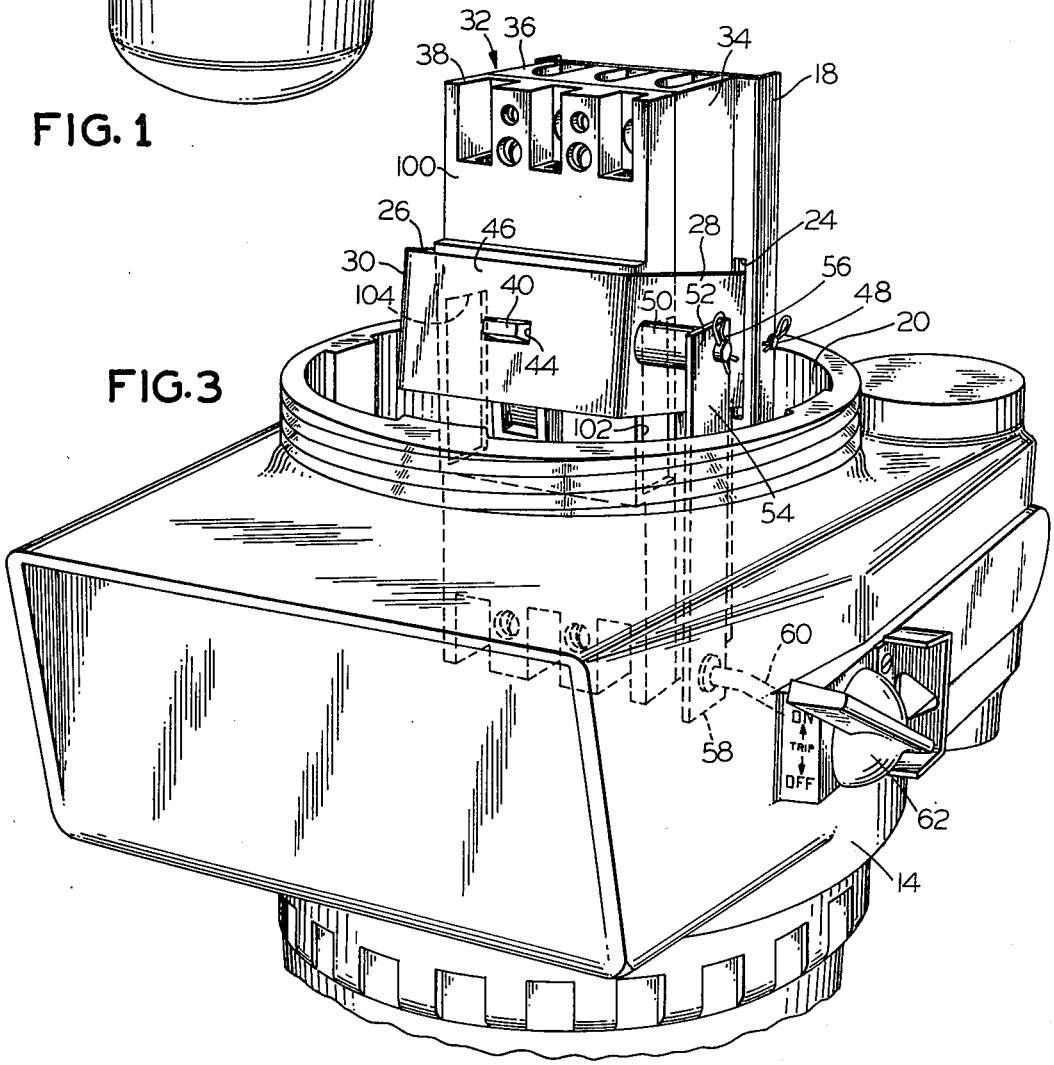
FIG. 3 is an enlarged perspective view of the medial part of an explosion-proof enclosure and a circuit breaker fixed to the mounting plate shown in FIG. 2, wherein the circuit breaker is in the on position.
Figure 4:
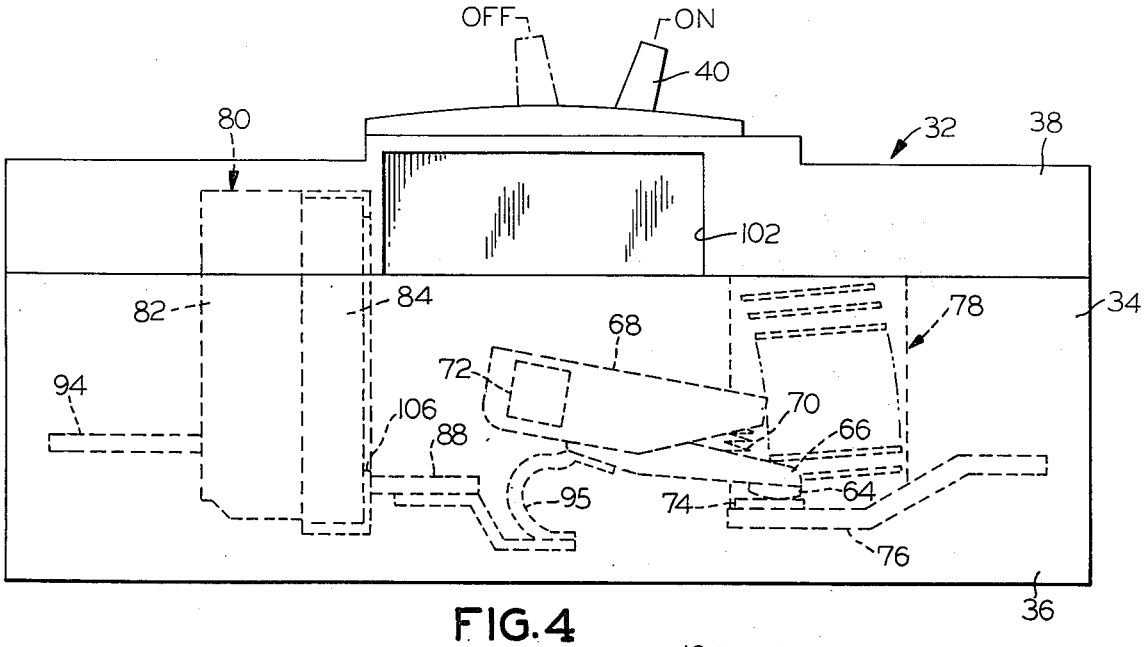
FIG. 4 is a side view of the circuit breaker shown in FIG. 3.

As shown in FIG. 2, a mounting plate 18 is shown extending outwardly through an opening 20 in medial part 14, wherein the mounting plate is fixed within the medial part of the threaded explosion-proof enclosure using standard fastening techniques. Mounting plate 18 also has, as shown in FIG. 2, side slots 22 and 24 for receiving respective end members 26 and 28 of a generally U-shaped bail 30, as shown in FIG. 3. Also shown in FIG. 3 is a circuit breaker 32 affixed via standard mounting means to mounting plate 18. Circuit breaker 32 can be a standard readily available circuit breaker such as a Model TFK circuit breaker sold by the Circuit Protective Devices Department of General Electric Company. Circuit breaker 32 is comprised of a generally rectangular insulating case 34 having a base portion 36 and a mating cover portion 38. An operating handle 40 is centrally located along a longitudinal axis 42, shown in FIG. 5, and extends outwardly from the center of cover portion 38, as shown in FIGS. 3 and 4, whereby the handle is movable between an on and an off position. In FIGS. 3 and 4, the handle is already shown to be in an on position.

Referring to FIG. 3, handle 40 is received and in locking engagement within a slot 44 in a base member 46 of bail 30. End members 26 and 28 of bail 30 are pivotaly mounted within slots 22 and 24 of mounting plate 18 using standard pin mounting means, such as a pin and rod arrangement 48 shown in association with end 28. Using a rigid connecting member 50, end 28 of bail 30 is mechanically coupled to one end 52 of a rigid bar 54, again using a standard pivotal pin mounting means 56. Another end 58 of rigid bar 54 is mechanically coupled via a rigid coupling member 60 to a manually operable enclosure handle 62, which is located externally of medial part 14 of enclosure 10. As shown in FIG. 3, enclosure handle 62 is movable between an on and an off position such that when the enclosure handle is in the on position, bail 30 secures circuit breaker handle 40 in the on position, and when enclosure handle 62 is moved to the off position, the bail is pivoted downward forcing the circuit breaker handle to be in the off position. Thus, the combination of enclosure handle 62, rigid bar 54, bail 30 and coupling members 50 and 60 provide a means operable externally of the enclosure for moving circuit breaker handle 40 between the on and off positions.

Circuit breaker 32 can actually be a three-pole electric circuit breaker having three relatively movable contacts 64, shown in FIG. 4 (only one pole being shown in this example), each carried by a movable contact support member 66 which in turn is pivotally supported by a movable contact arm 68. A compression spring member 70 is interposed between contact support member 66 and movable contact arm 68 for the purpose of providing contact pressure when the circuit breaker handle is in the on position. Contact arm 68 is pivotally connected to a square cross arm 72 (as are the other contact arms of the other two poles of the circuit breakers). When the circuit breaker handle is in the on position, the circuit breaker is closed, and each movable contact 64 is in engagement with a stationary contact 74, wherein stationary contact 74 is mounted on a corresponding line terminal strap 76, which is supported within base 36 of the circuit breaker case. Also included within the circuit breaker is an arc extinguishing means or structure which may comprise a stack of arc extinguishing plates of ceramic or steel, as shown generally at 78 in FIG. 4, and positioned in the pole chambers adjacent stationary contact 74 and movable contact 64 for the purpose of minimizing, surpressing and extinguishing the arc which is created by the flow of heavy overload currents between the movable and stationary contacts when those contacts are parted to interrupt the overload currents in the main conductors of the circuit breaker.

Figure 6:
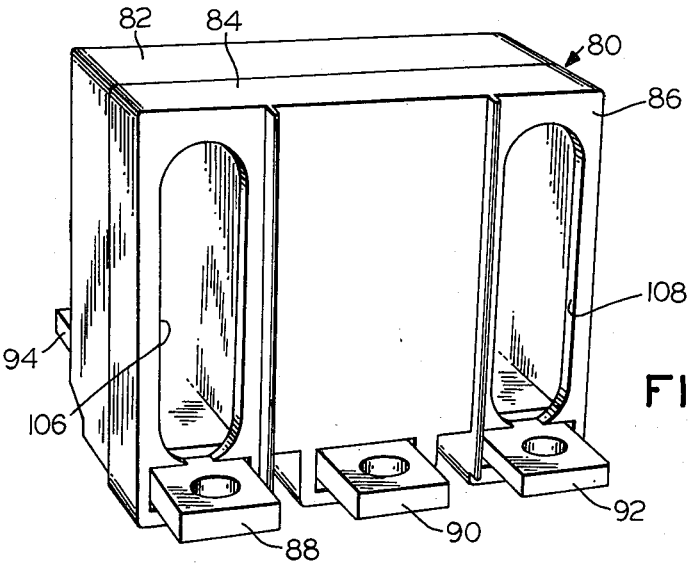
FIG. 6 is a perspective view of the trip mechanism housing shown in FIGS. 4 and 5.

Also included within circuit breaker 32, at an end opposite the position of the arc extinguishing means, is a trip (unit) mechanism housing 80, shown in FIGS. 4 and 6. Trip unit housing 80 is comprised of a pair of insulating casing parts 82 and 84 which cooperate to provide a closed box-like enclosure for a trip (unit) mechanism (not shown) which is enclosed therein. The trip mechanism, in this instance, is a unit which is removable from the casing, the structure and operation of which is more completely described in U.S. Pat. No. 3,264,435 assigned to the same assignee as the assignee of the present invention. Extending outwardly from the bottom of a side 86 of trip (unit) mechanism housing 80, which side faces the three poles of the circuit breaker, are terminal straps 88, 90 and 92 which are electrically connected to and have respective counterpart portions extending from the opposite side of the trip mechanism housing. It should be noted that in FIGS. 4 and 6, only one such additional terminal strap 94 is shown extending from the opposite side of the trip mechanism housing and in electrical connection with terminal strap 88, wherein rearwardly extending terminal strap 94 and the others (not shown) are electrically connected to externally located terminals on the circuit breaker case for connection to a load. Similarly, the stationary contacts of the circuit breaker are electrically connected to externally located terminals for providing connection to the supply side of power lines. Electrical connection between contact support member 66 of each pole and a respective terminal strap, i.e., terminal strap 88 as shown in FIG. 4, is provided by a flexible connector 95. A more complete description and operation of the electrical and mechanical circuit breaker components within case 34 and trip mechanism housing 80 can be found in U.S. Pat. Nos. 3,155,803, 3,171,927 and 3,264,435, all of which are assigned to the same assignee as the assignee of the present invention.

Figure 5:
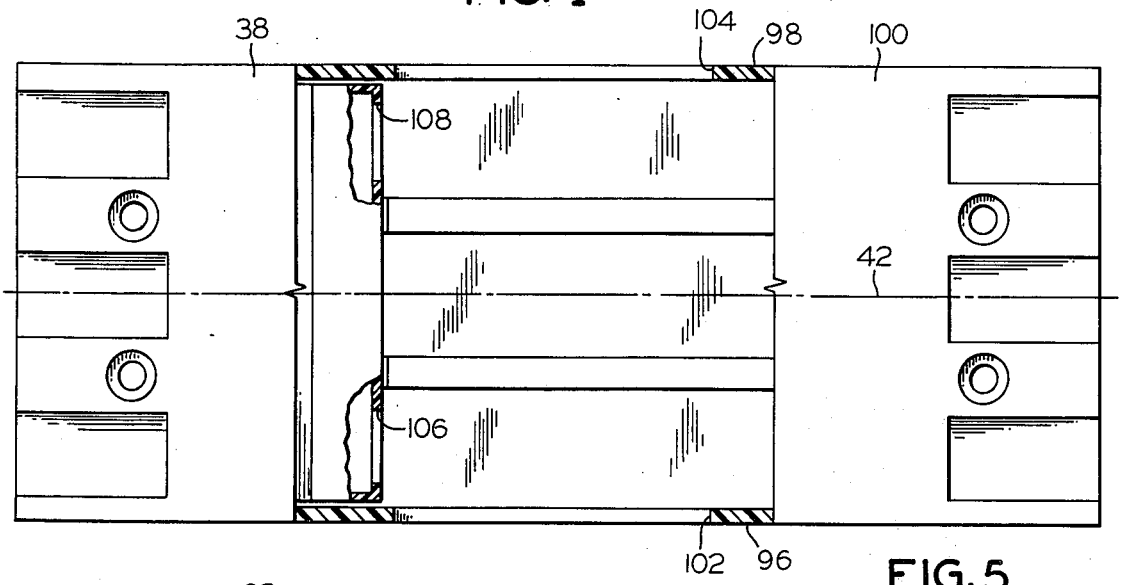
FIG. 5 is a top partial sectional view of the circuit breaker shown in FIGS. 3 and 4, which shows the holes in the trip mechanism housing and the sides of the cover portion of the circuit breaker.

Means for preventing exploding gases within the explosion-proof enclosure from shattering case 34 of the circuit breaker is provided by respective sides 96 and 98, which extend from opposite edges of a top part 100 of cover portion 38 and in a direction parallel to longitudinal axis 42, having respective rectangular holes 102 and 104 therein, wherein sides 96 and 98 form part of the sides of case 34. Holes 102 and 104 are on opposite sides of handle 40 and are located between trip (unit) mechanism housing 80 and arc extinguishing means 78, wherein each hole in its respective side of the cover portion encompasses the major area thereof extending between the trip unit housing and the arc extinguishing means. As shown in FIGS. 5 and 6, the means for preventing exploding gases within the explosion-proof enclosure from shattering the case of the circuit breaker further includes side 86 of trip (unit) mechanism housing 80 having first and second slots 106 and 108 extending upwardly from terminal straps 88 and 92 for allowing exploding gases within the enclosure to pass between hole 102 in side 96 of cover portion 38 of the circuit breaker and slot 106 in side 86 of trip mechanism housing 80, and also to allow exploding gases within the enclosure to pass between hole 104 in side 98 of cover portion 38 and slot 108 in side 86 of trip mechanism housing 80, whereby to prevent the shattering of the trip mechanism housing and the cover portion of the circuit breaker by the explosion of gases within enclosure 10. It should be noted that (as shown in FIG. 6)

slots 106 and 108, by way of example only, are shown to have a width approximately correpsonding to the width of respective terminal straps 88 and 92 and a height extending nearly the full height of side 86.

Figure 7:
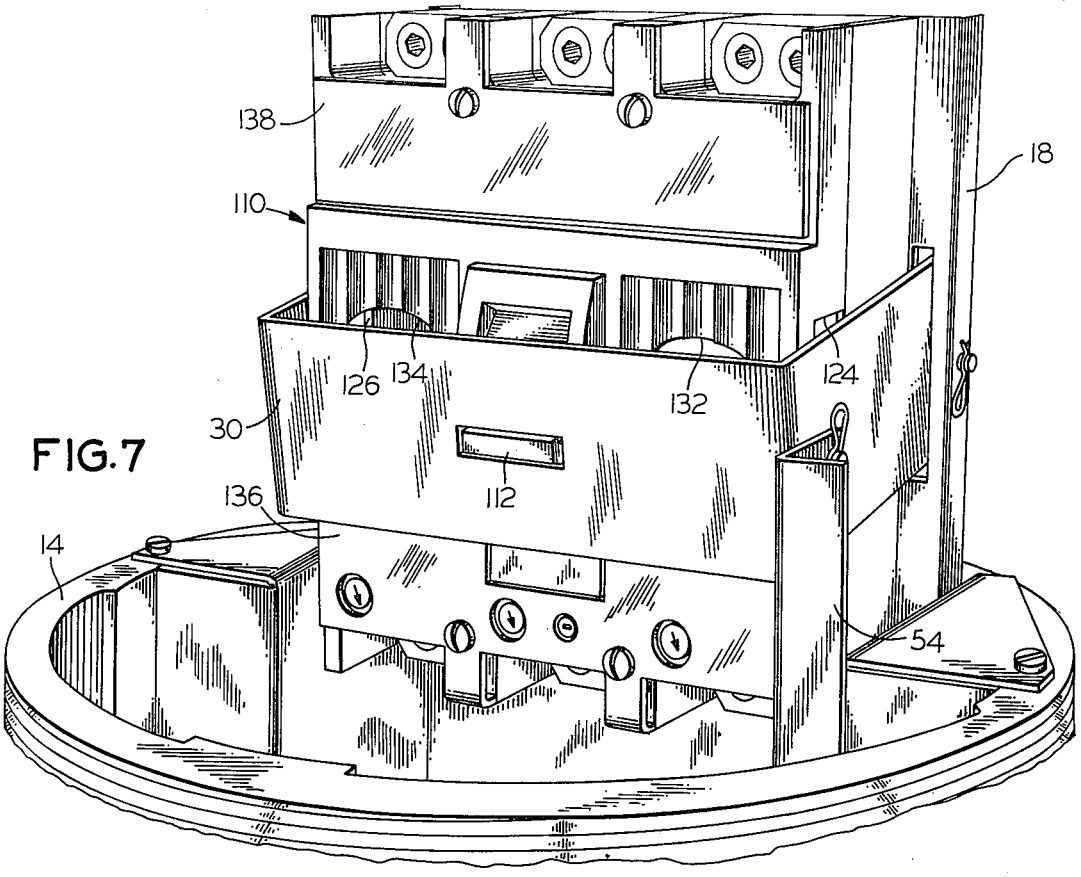
FIG. 7 is a partial perspective view of a circuit breaker attached to a mounting plate within an explosion-proof enclosure in another embodiment of the invention.
Figure 8:
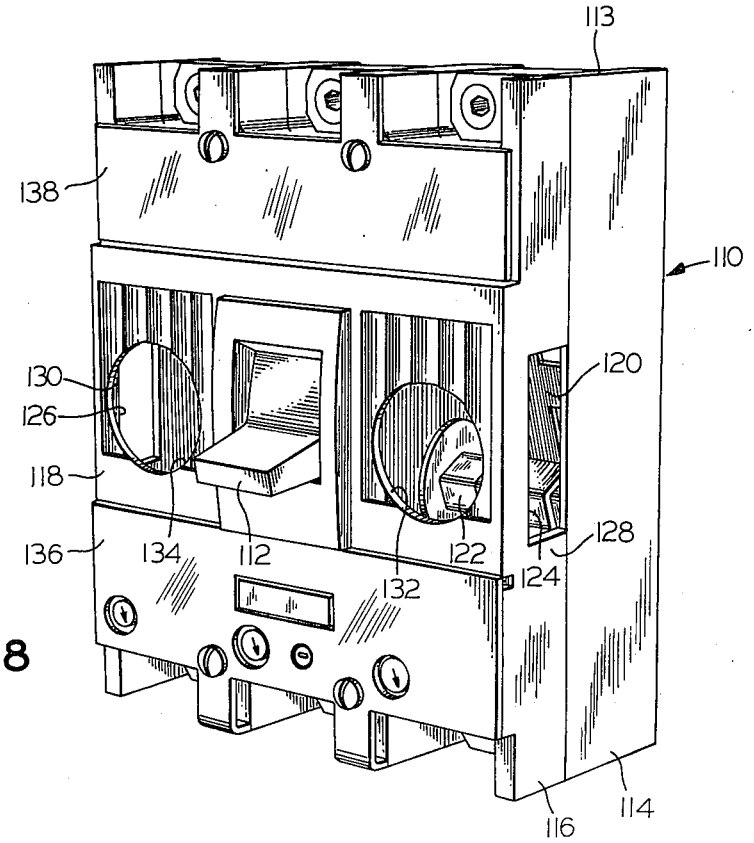
FIG. 8 is an unobstructed perspective view of the case of the circuit breaker shown in FIG. 7, which includes other means for preventing the shattering of the case of the circuit breaker by the explosion of gases within the threaded explosion-proof enclosure.

In another embodiment of the invention, referring to FIGS. 7 and 8, a circuit breaker 110 is similarly mounted to mounting plate 18 as previously described. The circuit breaker again has a handle 112 coupled to bail 30, wherein rigid bar 54 and medial part 14 and the remainder of enclosure 10 are the same as described in the previous embodiment. In this example, circuit breaker 10 can be a Model TJK or TJJ circuit breaker made by the Circuit Protective Devices Department of General Electric Company, wherein a further description and operation of the circuit breaker is provided in U.S. Pat. No. 3,258,572 assigned to the same assignee as the assignee of the present invention. In FIGS. 7 and 8, circuit breaker 110 has a case 113 which is comprised of a base portion 114 and a cover portion 116. Again, handle 112 extends through a top part 118 of cover portion 116, and, in this instance, handle 112 is shown in FIGS. 7 and 8 to be in the off position. While the circuit breaker in FIGS. 7 and 8 has been referred to as a TJK or a TJJ circuit breaker, it still has arc extinguishing means located adjacent contacts of a pole within the upper region thereof, and a trip mechanism (unit) housing located within the lower region thereof, although they are not explicitly shown in FIG. 8. Similarly, for purposes of simplicity, only one movable contact arm 120 of one pole of the three-pole circuit breaker and a cross arm 122 are shown to be within case 113. In this embodiment, the means for preventing the shattering of the circuit breaker case by exploding gases within enclosure 10 is again provided by first and second rectangular holes 124 and 126 located within respective opposite sides 128 and 130 of cover portion 116 and positioned opposite handle 112. Again holes 124 and 126 extend between the arc extinguishing means and the trip mechanism housing (both not shown) within case 113, wherein these holes consume the major part of the area of the respective sides of cover portion 116 which extend between the arc extinguishing means and the trip mechanism housing. Alternatively, holes 124 and 126 can be said to extend substantially along the length of movable contact arm 120. In addition to holes 124 and 126, the means for preventing exploding gases from shattering the case of the circuit breaker also includes a pair of holes 132 and 134 located again on opposite sides of handle 112 and extending within top part 118 of cover portion 116. By way of example, holes 132 and 134 can be round and have a diameter which extends over a major portion of the width of the pole chamber which each hole overlies. Additionally, the preventing means can further include a structural support plate 136, which is fixed over the lower portion of top part 118 that overlies the trip unit (device) housing (not shown) within case 113, and another structural supporting plate 138, which extends over the upper portion of top part 118 of cover portion 116 that overlies the arc extinguishing means (not shown). Thus, FIGS. 7 and 8 illustrate additional means located on opposite sides of handle 112 which result in preventing the shattering of any external or internal portions of the case of the circuit breaker as a result of explosions within enclosure 10.

Although this invention has been described with reference to specific embodiments thereof, numerous modifications are possible without departing from the invention, and it is desirable to cover all modifications falling within the spirit and scope of this invention.

What I claim as new and desire to secure by Letters Patent of the United States is:

1. In combination, a. an explosion-proof enclosure;

b. a circuit breaker mounted within said enclosure, said circuit breaker comprising an insulating case, and a manually operable handle member extending from one surface of said case and movable between an on and an off position for opening and closing said circuit breaker;

c. means operable externally of said enclosure for moving said handle of said circuit breaker between said on and off positions; and d. means provided by said case of said circuit breaker located on opposite sides of said handle of the circuit breaker for preventing exploding gases within said explosion-proof enclosure from shattering said case of said circuit breaker.

2. The combination according to claim 1, wherein said case is comprised of a base portion, and a cover portion attached to said base portion, said cover portion having a top part and at least first and second sides extending from opposite edges of said top part in a direction parallel to a longitudinal axis of said cover portion, said sides of said cover portion forming part of the sides of said case.

3. The combination according to claim 2, wherein said handle of said circuit breaker extends through said top part along the longitudinal axis of said cover portion, and said circuit breaker including therein a trip mechanism housing and arc extinguishing means centrally positioned along the longitudinal axis of said cover portion and on opposite sides of said handle.

4. The combination according to claim 3, wherein said preventing means is comprised of each of said sides of said case having a hole located between said trip mechanism housing and said arc extinguishing means.

5. The combination according to claim 4, wherein said holes in said sides of said case are formed within said cover portion and encompass substantially the major area of each of said sides extending between said trip mechanism housing and said arc extinguishing means.

6. The combination according to claim 4, wherein said preventing means is further comprised of said top part of said cover portion having a pair of holes located therethrough on respective opposite sides of said handle and between said trip mechanism housing and said arc extinguishing means.

7. The combination according to claim 5 further comprising said trip mechanism housing having first, second and third terminal straps extending outwardly from a first side thereof which is immediately adjacent said holes in said sides of said cover portion, said first and third terminal straps being located on opposite sides of said second terminal strap.

8. The combination according to claim 7, wherein said preventing means is further comprised of said first side of said trip mechanism housing having first and second slots extending upwardly from said respective first and third terminal straps for allowing exploding gases within said enclosure to pass between said first hole in said first side of said cover portion and said first slot in said trip mechanism housing and between said second hole in said second side of said cover portion and said second slot in said trip mechanism housing, whereby to prevent the shattering of said trip mechanism housing and said cover portion of said circuit breaker.

9. The combination according to claim 6, wherein said preventing means is comprised of a first structural supporting plate extending over that portion of said top part of said cover portion which overlies said trip mechanism housing.

10. The combination according to claim 9, wherein said preventing means is further comprised of a second structural supporting plate extending over that portion of said top part of said cover portion overlying said arc extinguishing means.

* * * * *